US006367186B1

(12) United States Patent
Gibala

(10) Patent No.: US 6,367,186 B1
(45) Date of Patent: Apr. 9, 2002

(54) TWO-SHOT, SINGLE BARREL MUZZLE-LOADING FIREARM

(76) Inventor: Rocco Gibala, 2125 Clintonville Rd., Winchester, KY (US) 40391

( * ) Notice: Subject to any disclaimer, the term of this patent is extended or adjusted under 35 U.S.C. 154(b) by 0 days.

(21) Appl. No.: 09/591,395

(22) Filed: Jun. 9, 2000

(51) Int. Cl.[7] ..... F41C 9/08
(52) U.S. Cl. ..... 42/51
(58) Field of Search ..... 42/51; 89/1.3

(56) References Cited

U.S. PATENT DOCUMENTS

| | | | | | |
|---|---|---|---|---|---|
| 2,441 | A | | 2/1842 | Griswold | |
| 15,041 | A | * | 6/1856 | Kesling | 42/51 |
| 17,233 | A | | 5/1857 | Read | |
| 30,332 | A | | 10/1860 | Lindsay | |
| 2,259,397 | A | | 10/1941 | Smith | |
| 3,780,464 | A | * | 12/1973 | Anderson | 42/51 |
| 4,065,866 | A | | 1/1978 | Equizabal | |
| 4,114,303 | A | | 9/1978 | Vaughn | |
| D299,673 | S | | 1/1989 | Knight | |
| 5,133,143 | A | * | 7/1992 | Knight | 42/51 |
| 5,644,861 | A | * | 7/1997 | Knight | 42/51 |
| 5,651,207 | A | * | 7/1997 | Knight | 42/51 |

FOREIGN PATENT DOCUMENTS

| | | | | |
|---|---|---|---|---|
| FR | 1302590 | * | 7/1962 | 89/1.3 |

* cited by examiner

*Primary Examiner*—Stephen M. Johnson

(57) ABSTRACT

A two-shot, single barrel muzzle-loading firearm for allowing a user to quickly get off a second shot without having to reload. The two-shot, single barrel muzzle-loading firearm includes a stock having a hole therein for receiving and storing a ramrod with the hole extending from a front of the stock to nearly a butt of the stock; and also includes a barrel having a bore extending from a muzzle end through a breech end and further having a constricted portion machined to receive a rear of the bullet in the firearm; and further includes a front nipple interconnected to the front section of the bore with a front flash channel, and also includes a rear nipple interconnected to the rear section of the bore with a rear flash channel, and further includes a firing mechanism including a sleeve, a spring-loaded striker slidably disposed in the sleeve and having a striker head and a handle member and being adjustably alignable with either the front nipple or the rear nipple, and including a sear for releasing the spring-loaded striker and a trigger member connected to the sear and adapted to be pulled by a user to release the striker.

15 Claims, 2 Drawing Sheets

11
13
35
40
40
19
39
21
42
43

11

14
26
25
29
5
5
21

50

15
52
17
23
51
27
14
30
24
18
32
26
29
53
16
11
19

TWO-SHOT, SINGLE BARREL MUZZLE-LOADING FIREARM

BACKGROUND OF THE INVENTION

1. Field of the Invention

The present invention relates to a two-shot muzzle-loading firearm and more particularly pertains to a new two-shot, single barrel muzzle-loading rifle and pistol for allowing a user to quickly get off a second shot without having to reload.

2. Description of the Prior Art

The use of a two-shot muzzle-loading firearm is known in the prior art. More specifically, a two-shot muzzle-loading firearm heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 30,332; U.S. Patent No. 2,259,397; U.S. Pat. No. 4,114,303; U.S. Pat. No. 2,441; U.S. Pat. No. 17,233; and U.S. Pat. No. 4,065,866.

While these devices fulfill their respective, particular objectives and requirements, the aforementioned patents do not disclose a new two-shot, single barrel muzzle-loading firearm. The inventive device includes a stock having a hole therein for receiving and storing a ramrod with the hole extending from a front of the stock to nearly a butt of the stock; and also includes a barrel having a bore extending from a muzzle end through a breech end and further having a constricted portion machined to receive a rear of the bullet in the firearm; and further includes a front nipple interconnected to the front section of the bore with a front flash channel, and also includes a rear nipple interconnected to the rear section of the bore with a rear flash channel, and further includes a firing mechanism including a sleeve, a spring-loaded striker slidably disposed in the sleeve and having a striker head and a handle member and being adjustably alignable with either the front nipple or the rear nipple, and including a sear for releasing the spring-loaded striker and a trigger member connected to the sear and adapted to be pulled by a user to release the striker.

In these respects, the two-shot, single barrel muzzle-loading firearm according to the present invention substantially departs from the conventional concepts and designs of the prior art, and in so doing provides an apparatus primarily developed for the purpose of allowing a user to quickly get off a second shot without having to reload.

SUMMARY OF THE INVENTION

In view of the foregoing disadvantages inherent in the known types of a two-shot muzzle-loading firearm now present in the prior art, the present invention provides a new two-shot, single barrel muzzle-loading firearm construction wherein the same can be utilized for allowing a user to quickly get off a second shot without having to reload.

The general purpose of the present invention, which will be described subsequently in greater detail, is to provide a new two-shot, single barrel muzzle-loading firearm which has many novel features which are not anticipated, rendered obvious, suggested, or even implied by any of the prior art for two-shot, single barrel muzzle-loading firearms, either alone or in any combination thereof.

To attain this, the present invention generally comprises a stock having a hole therein for receiving and storing a ramrod with the hole extending from a front of the stock to nearly a butt of the stock; and also includes a barrel having a bore extending from a muzzle end through a breech end and further having a constricted portion machined to receive a rear of the bullet in the firearm; and further includes a front nipple interconnected to the front section of the bore with a front flash channel, and also includes a rear nipple interconnected to the rear section of the bore with a rear flash channel, and further includes a firing mechanism including a sleeve, a spring-loaded striker slidably disposed in the sleeve and having a striker head and a handle member and being adjustably alignable with either the front nipple or the rear nipple, and including a sear for releasing the spring-loaded striker and a trigger member connected to the sear and adapted to be pulled by a user to release the striker.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new two-shot, single barrel muzzle-loading firearm which has many novel features which are not anticipated, rendered obvious, suggested, or even implied by any of the prior art for two-shot, single barrel muzzle-loading firearms, either alone or in any combination thereof.

It is another object of the present invention to provide a new two-shot, single barrel muzzle-loading firearm which may be easily and efficiently manufactured and marketed.

It is a further object of the present invention to provide a new two-shot, single barrel muzzle-loading firearm which is of a durable and reliable construction.

An even further object of the present invention is to provide a new two-shot, single barrel muzzle-loading firearm which is susceptible of a low cost of manufacture with regard to both materials and labor, and which accordingly is then susceptible of low prices of sale to the consuming public, thereby making such two-shot, single barrel muzzle-loading firearm economically available to the buying public.

Still yet another object of the present invention is to provide a new two-shot, single barrel muzzle-loading firearm which provides in the apparatuses and methods of the prior art some of the advantages thereof, while simultaneously overcoming some of the disadvantages normally associated therewith.

Still another object of the present invention is to provide a new two-shot, single barrel muzzle-loading firearm for allowing a user to quickly get off a second shot without having to reload.

Yet another object of the present invention is to provide a new two-shot, single barrel muzzle-loading firearm which includes a stock having a hole therein for receiving and storing a ramrod with the hole extending from a front of the stock to nearly a butt of the stock; and also includes a barrel having a bore extending from a muzzle end through a breech end and further having a constricted portion machined to receive a rear of the bullet in the firearm; and further includes a front nipple interconnected to the front section of the bore with a front flash channel, and also includes a rear nipple interconnected to the rear section of the bore with a rear flash channel, and further includes a firing mechanism including a sleeve, a spring-loaded striker slidably disposed in the sleeve and having a striker head and a handle member and being adjustably alignable with either the front nipple or the rear nipple, and including a sear for releasing the spring-loaded striker and a trigger member connected to the sear and adapted to be pulled by a user to release the striker.

Still yet another object of the present invention is to provide a new two-shot, single barrel muzzle-loading firearm that is easy and convenient to use.

Even still another object of the present invention is to provide a new two-shot, single barrel muzzle-loading firearm that a user can simply pull back and rotate the handle member on the spring-loaded striker to fire a second bullet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
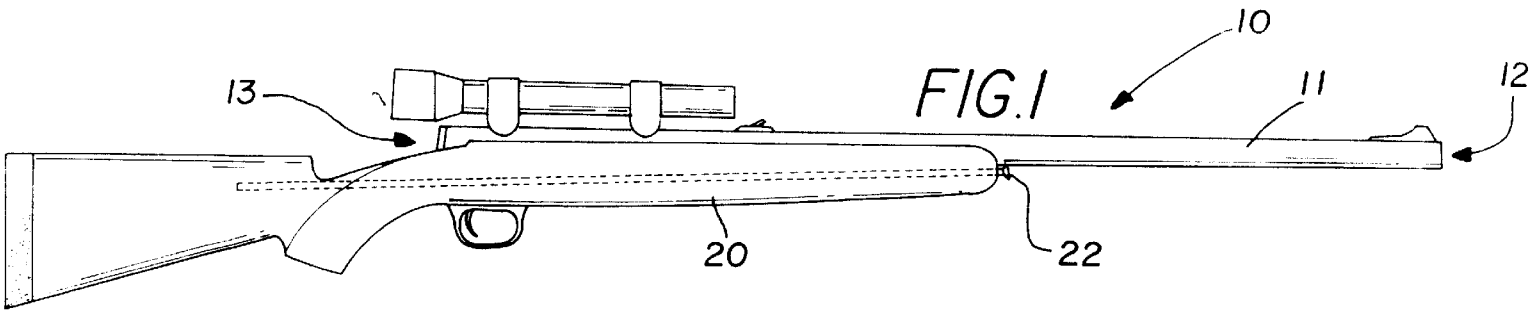
FIG. 1 is a side elevational view of a new two-shot, single barrel muzzle-loading firearm according to the present invention.
Figure 2:
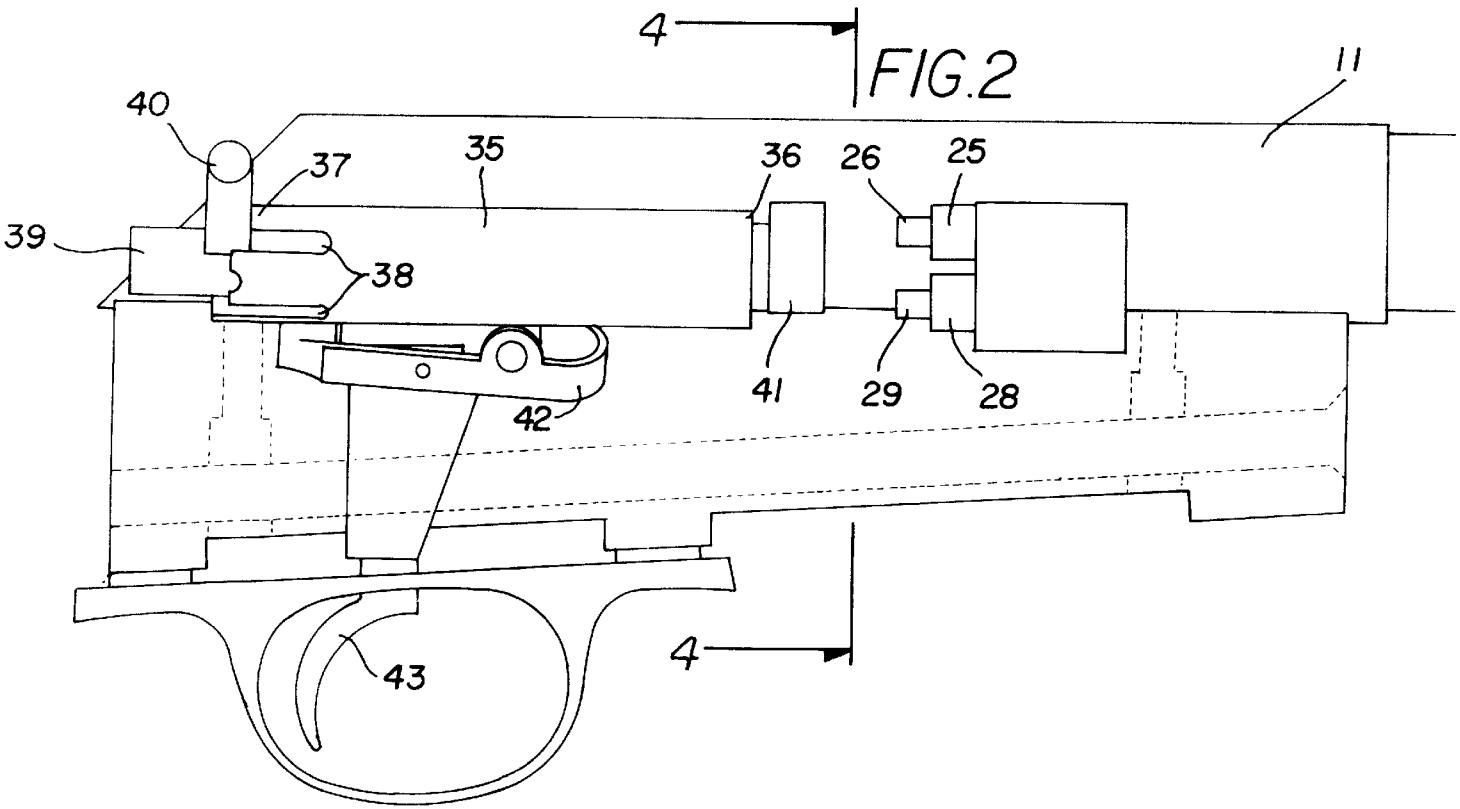
FIG. 2 is a detailed side elevational view of the barrel of the present invention.
Figure 3:
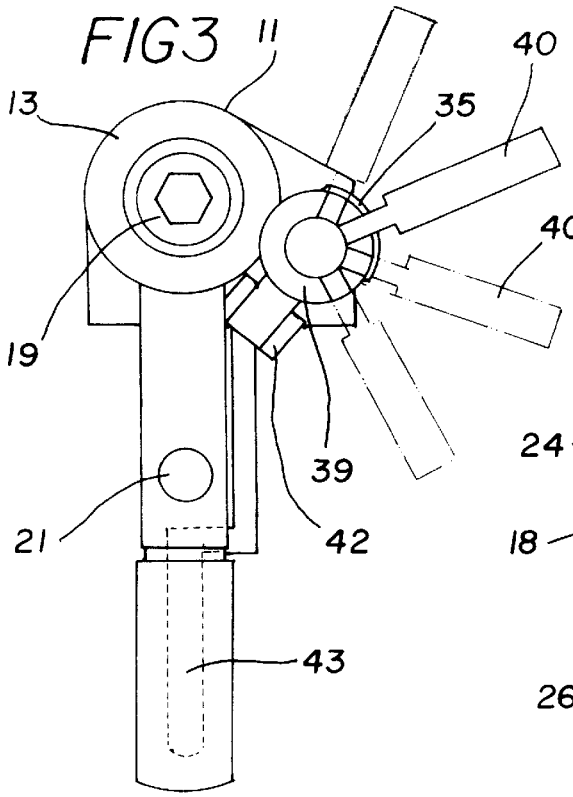
FIG. 3 is a rear elevational view of the present invention.
Figure 4:
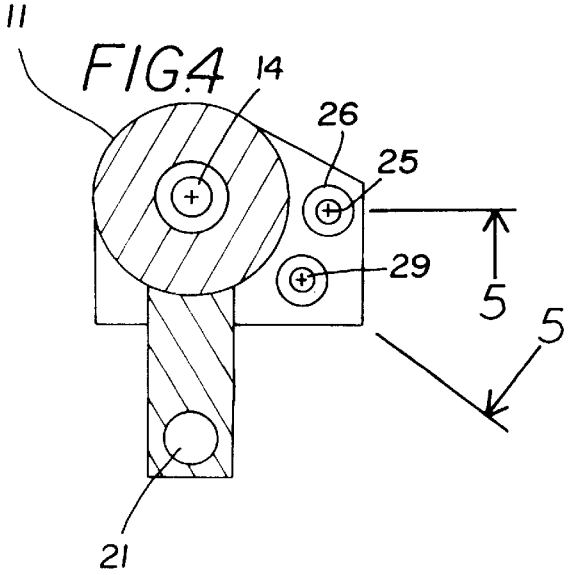
FIG. 4 is a rear detailed cross-sectional view of the present invention.
Figure 5:
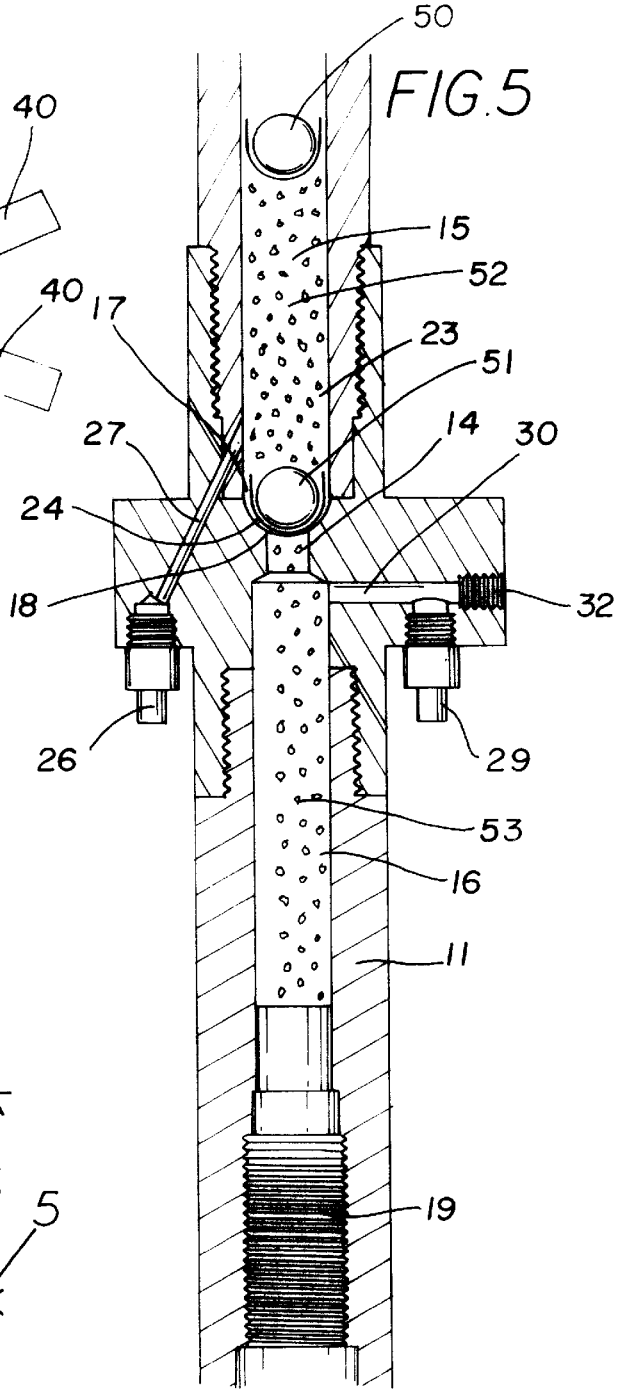
FIG. 5 is a side cross-sectional view of the present invention.

With reference now to the drawings, and in particular to FIGS. 1 through 5 thereof, a new two-shot, single barrel muzzle-loading firearm embodying the principles and concepts of the present invention and generally designated by the reference numeral 10 will be described.

As best illustrated in FIGS. 1 through 5, the two-shot, single barrel muzzle-loading firearm 10 generally comprises a stock 20 having a hole 21 for receiving and storing a ramrod 22 with the hole extending from the front of the stock to nearly the butt of the stock, and further comprises a barrel 11 supported by the stock 20 and having a muzzle end 12, a breech end 13, and a bore 23 extending through the muzzle end 12 and through the breech end 13 and defining a barrel wall 17. The bore 23 has a constricted portion 14 intermediate of the muzzle end 12 and the breech end 13 and defines a bullet seat 24 forward of the constricted portion 14. The bore 23 includes a front section 15 disposed between the constricted portion 14 and the muzzle end 12, and further includes a rear section 16 disposed between the constricted portion 14 and the breech end 13. The bullet seat 24 at a front end 18 of the constricted portion 14 is accurately machined to fit the back of the rear bullet to be fired from the firearm 10. A breech plug 19 is removably engaged in the breech end 13 of the barrel 11. The constricted portion of the bore 14 has a diameter no larger than approximately one half the diameter of the bore 23.

A means for igniting powder 52,53 disposed within the bore 23 for firing bullets 50,51 out of the bore 23 through the muzzle end 12 includes percussion caps placed on nipples 26,29. A blow by the striker head 41 on the percussion caps on nipple 26 sends fire through the nipple 26 and front flash channel 27 into the front powder charge 52, thus propelling the front bullet 50 out of the bore 23 through the muzzle end 12. A subsequent blow by the striker head 41 on the percussion cap on nipple 29 sends fire through nipple 29 and rear flash channel 30 into the rear powder charge 53, thus propelling the rear bullet 51 out of the bore 23 through the muzzle end 12.

A firing mechanism for igniting powder 52,53 disposed in the bore 23 includes a sleeve 35 having a front end 36 and a rear end 37 and a pair of longitudinal slots 38 spaced apart and extending in the rear end 37 thereof and being located adjacent to an outer side of the barrel 11. A spring-loaded striker 39 is slidably and adjustably disposed within the sleeve 35 and is slidable through the front end 36 and has a striker head 41 at a front end thereof. A handle member 40 is securely attached to the striker 39 near a rear end thereof. A sear 42 is conventionally connected to the sleeve 35 and is engageable to the striker 39 for the releasing thereof. A trigger member 43 is attached to the sear 42 for releasing the spring-loaded striker 39. The spring-loaded striker 39 is rotatably adjustable such that the striker head 41 can be positioned to strike either the nipple 26 for the front powder charge 52 or the nipple 29 for the rear powder charge 53 as selected by a user. The striker head 41 is alignable with the nipple 26 for the front powder charge 52 and with the nipple 29 for the rear powder charge 53. A front flash channel 27 extends through the side of the barrel 11 from the nipple 26 to the front section 15 of the bore 23. A rear flash channel 30 extends through the side of the barrel 11 from the nipple 29 to the rear section 16 of the bore 23.

In use, the user will load powder 53 into the rear section 16 of the bore 23 in the barrel 11 and will place a rear bullet 51 in the front section 15 of the bore 23 and rest it against the bullet seat 24. The user will then load powder 52 into the front section 15 of the bore 23 forward of the rear bullet 51 and then place the front bullet 50 in the front section 15 of the bore 23 forward of the powder 52 therein. The user will then place percussion caps on the two nipples 26,29. To shoot the front bullet 50, the user will pull back and rotate the striker 39 using the handle member 40 such that the striker head 41 is in alignment with the nipple 26, and will then pull back on the trigger member 43 which moves the sear 42 downward which releases the spring-loaded striker 39 which strikes the percussion cap on nipple 26 thus igniting the powder 52 in the front section 15 of the bore 23 which propels the front bullet 50 out through the muzzle end 12. To shoot the rear bullet 51, the user the user will pull back and rotate the striker 39 using the handle member 40 such that the striker head 41 is in alignment with the nipple 29 and will then pull back on the trigger member 43 which moves the sear 42 downward which releases the spring-loaded striker 39 which strikes the percussion cap on nipple 29 thus igniting the powder 53 in the rear section 16 of the bore 23 which propels the rear bullet 51 out through the muzzle end 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a stock having a hole for receiving and storing a ramrod, said hole extending from a front of said stock to a back of a butt of said stock;

a barrel supported by said stock and having a muzzle end, a breech end, and a bore extending through said muzzle end and terminating at said breech end and defining a barrel wall, said bore having a constricted portion intermediate of said muzzle end and said breech end and defining a bullet seat forward of said constricted portion;

a means for igniting powder disposed within said bore for firing bullets out of said bore through said muzzle end; and a firing mechanism for triggering said means for igniting powder disposed in said bore;

wherein said bore includes a front section disposed between said constricted portion and said muzzle end, and further includes a rear section disposed between said constricted portion and said breech end;

wherein said means for igniting powder includes front and rear nipples each having a percussion cap placed thereon, and also including front and rear flash channels for interconnecting powder charges;

wherein said percussion cap on said front nipple is adapted to ignite powder disposed in said front section of said bore to propel a bullet disposed forward of the powder, and said percussion cap on said rear nipple is adapted to ignite powder disposed in said rear section of said bore to propel a bullet resting against said bullet seat.

2. A firearm as described in claim 1, wherein said bullet seat is located at a front end of said constricted portion which is machined to match a rear of a bullet placed there against.

3. A firearm as described in claim 2, further includes a breech plug removably engaged in said breech end.

4. A firearm as described in claim 1, wherein said front flash channel extends into said front section of said bore forward of a bullet resting against said bullet seat, and said rear flash channel extends into said rear section of said bore.

5. A firearm as described in claim 1, wherein said front and rear nipples are disposed on one or more outer sides of said barrel.

6. A firearm as described in claim 1, wherein said firing mechanism includes a sleeve having a front end and a rear end and a pair of longitudinal slots spaced apart and extending in said rear end thereof and being located adjacent to an outer side of said barrel, a spring-loaded striker slidably and adjustably disposed within said sleeve and being slidable through said front end and having a striker head at a front end thereof, a handle member attached to said striker near a rear end thereof, a sear engageable to said striker for releasing thereof, and a trigger member attached to said sear for releasing said spring-loaded striker.

7. A firearm as described in claim 6, wherein said spring-loaded striker is rotatably adjustable such that said striker head can be positioned to strike either said nipple for said front powder charge or said nipple for said rear powder charge as selected by the user.

8. A firearm as described in claim 6, wherein said striker head is alignable with said front nipple for said front powder charge and with said rear nipple for said rear powder charge.

9. A firearm as described in claim 1, wherein said constricted portion has a diameter of no larger than ½ that of a diameter for said bore.

10. A two-shot, single barrel muzzle-loading firearm comprising:

a stock having a hole for receiving and storing a ramrod, said hole extending from a front of said stock to a back of a butt of said stock;

a barrel supported by said stock and having a muzzle end, a breech end, and a bore extending through said muzzle end and terminating at said breech end and defining a barrel wall, said bore having a constricted portion intermediate of said muzzle end and said breech end and defining a bullet seat forward of said constricted portion;

a means for igniting powder disposed within said bore for firing bullets out of said bore through said muzzle end; and a firing mechanism for triggering said means for igniting powder disposed in said bore;

wherein said bore includes a front section disposed between said constricted portion and said muzzle end, and further includes a rear section disposed between said constricted portion and said breech end;

wherein said bullet seat being at a front end of said constricted portion which is machined to match a rear of a bullet placed there against;

a breech plug being removably engaged in said breech end;

wherein said means for igniting powder includes nipples and percussion caps placed thereupon, and also including a front and rear flash channels interconnecting powder charges;

wherein said front flash channel extends into said front section of said bore forward of a bullet resting against said bullet seat, and said rear flash channel extends into said rear section of said bore;

wherein said nipples include front and rear nipples disposed on one or more outer sides of said barrel;

wherein said percussion cap on said front nipple is adapted to ignite powder disposed in said front section of said bore to propel a bullet disposed forward of the powder, and said percussion cap on said rear nipple is adapted to ignite powder disposed in said rear section of said bore to propel a bullet resting against said bullet seat.

11. A two-shot, single barrel muzzle-loading firearm as described in claims 10, wherein said firing mechanism includes a sleeve having a front end and a rear end and a pair of longitudinal slots spaced apart and extending in said rear end thereof and being located adjacent to an outer side of said barrel, a spring-loaded striker slidably and adjustably disposed within said sleeve and being slidable through said front end and having a striker head at a front end thereof, a handle member attached to said striker near a rear end thereof, a sear engageable to said striker for releasing thereof, and a trigger member attached to said sear for releasing said spring-loaded striker.

12. A two-shot, single barrel muzzle-loading firearm as described in claim 11, wherein said spring-loaded striker is rotatably adjustable such that said striker head can be positioned to strike either said nipple for said front powder charge or said nipple for said rear powder charge as selected by the user.

13. A two-shot, single barrel muzzle-loading firearm as described in claim 11, wherein said striker head is alignable with said front nipple for said front powder charge and with said rear nipple for said rear powder charge.

14. A two-shot, single barrel muzzle-loading firearm as described in claim 10, wherein said constricted portion has a diameter of no larger than ½ that of a diameter for said bore.

15. A two-shot, single barrel muzzle-loading firearm comprising:

a stock having a hole for receiving and storing a ramrod, said hole extending from a front of said stock to nearly a butt of said stock;

a barrel supported by said stock and having a muzzle end, a breech end, and a bore extending through said muzzle end and terminating at said breech end and defining a barrel wall, said bore having a constricted portion intermediate of said muzzle end and said breech end and defining a bullet seat forward of said constricted portion, said bore including a front section disposed between said constricted portion and said muzzle end, and further including a rear section disposed between said constricted portion and said breech end, said bullet seat at a front end of said constricted portion being accurately machined to match a rear of a bullet to be placed there against, and including a breech plug which is removably engaged in said breech end;

a means for igniting powder disposed within said bore for firing bullets out of said bore through said muzzle end including nipples and percussion caps placed thereupon, said nipples being interconnected to powder charges by front and rear flash channels, said front flash channel extending from a front one of said nipples into said front section of said bore forward of a rear bullet, and said rear flash channel extending from a rear one of said nipples into said rear section of said bore, said nipples being securely disposed on an outer side of said barrel, said front nipple being adapted to ignite powder disposed in said front section of said bore to essentially propel a bullet disposed forward of the powder, and said rear nipple being adapted to ignite powder disposed in said rear section of said bore to essentially propel a bullet resting against said bullet seat, said constricted portion having a diameter of no larger than ½ that of a diameter of said bore;

a firing mechanism for igniting powder disposed in said sections of said bore including a sleeve having a front end and a rear end and a pair of longitudinal slots spaced apart and extending in said rear end thereof and being located adjacent to an outer side of said barrel, a spring-loaded striker slidably and adjustably disposed within said sleeve and being slidable through said front end and having a striker head at a front end thereof, a handle member securely attached to said striker near a rear end thereof, a sear engageable to said striker for releasing thereof, and a trigger member securely attached to said sear for releasing said spring-loaded striker, said spring-loaded striker being rotatably adjustable such that said striker head can be positioned to strike either said front nipple for said front powder charge or said rear nipple for said rear powder charge, said striker head being alignable with said front nipple for said front powder charge and with said rear nipple for said rear powder charge.

* * * * *